US007069758B2

(12) United States Patent
Kariakin et al.

(10) Patent No.: US 7,069,758 B2
(45) Date of Patent: Jul. 4, 2006

(54) METAL STUD PUNCH SYSTEM AND A METHOD OF MANUFACTURE

(76) Inventors: Joseph Kariakin, 251 Sunset Ave., Keizer, OR (US) 97303; Aaron David Roth, 2012 Delaney Rd. SE., Salem, OR (US) 97306; Robert Brooks Taylor, 1816 Park Ave. NE., Salem, OR (US) 97303

( * ) Notice: Subject to any disclaimer, the term of this patent is extended or adjusted under 35 U.S.C. 154(b) by 127 days.

(21) Appl. No.: 10/917,028

(22) Filed: Aug. 11, 2004

(65) Prior Publication Data

US 2006/0032284 A1 Feb. 16, 2006

(51) Int. Cl.
*B21D 28/10* (2006.01)

(52) U.S. Cl. ..... 72/186; 72/326; 72/379.2

(58) Field of Classification Search ..... 72/326, 72/325, 421, 419, 417, 379.2, 184, 186, 185, 72/190; 83/318
See application file for complete search history.

(56) References Cited

U.S. PATENT DOCUMENTS 3,541,685 A * 11/1970 Gizdich ..... 30/363
3,896,650 A * 7/1975 O'Konski ..... 72/186
4,020,544 A * 5/1977 Smith et al. ..... 29/513
4,930,278 A 6/1990 Staresina
4,966,025 A * 10/1990 Ichikawa et al. ..... 72/184
5,414,972 A 5/1995 Ruiz
5,416,975 A * 5/1995 Saito et al. ..... 30/362
5,669,197 A 9/1997 Bodnar
5,850,686 A * 12/1998 Mertes ..... 29/809
5,937,719 A 8/1999 Davis
6,151,858 A 11/2000 Ruiz
6,397,362 B1 * 5/2002 Ishiyama ..... 714/724
6,708,459 B1 3/2004 Bodnar
6,837,013 B1 1/2005 Foderberg
6,938,452 B1 * 9/2005 Rudolph et al. ..... 72/325

* cited by examiner

*Primary Examiner*—Daniel C. Crane
(74) *Attorney, Agent, or Firm*—Carl D. Crowell

(57) ABSTRACT

A portable metal stud punching system has an alignment frame with an infeed alignment port in a first side and an outfeed alignment port in an opposite side. There is a punch and die positioned within the alignment frame. A length of metal stud is inserted through the infeed alignment port with one vertical side of the metal stud disposed between the punch and the die. A first hydraulic unit is attached to the punch and moves a first direction thereby inserting the punch into the die and punching a tab out of the vertical side of the metal stud. A second hydraulic unit moves the punch assembly in a direction perpendicular to the first direction of the first hydraulic unit. After the tab has been punched, the second hydraulic unit advances the metal stud by sliding the punch assembly a distance equal to the desired space between tabs. The punch is retracted by the first hydraulic unit and the punch assembly is returned to its original position by the second hydraulic unit.

7 Claims, 6 Drawing Sheets

METAL STUD PUNCH SYSTEM AND A METHOD OF MANUFACTURE

FIELD OF THE INVENTION

This invention relates generally to building construction, and more particularly to the construction of and method of manufacturing tabbed structural members for tilt-up style wall construction.

BACKGROUND OF THE INVENTION

Tilt-up building construction is well known in the construction industry. Tilt-up thin-shell construction is a method of construction where the walls or panels are formed horizontally on a building slab or foundation from light gauge metal framing embedded in thin (1.5" to 2") concrete. Thin-shell construction is distinguished from traditional tilt-up construction which uses steel rebar inside of 6" to 8" thick concrete walls, rather than thinner concrete with external steel. There are obvious advantages to the newer thin-shell systems in material savings and ease of transporting and handling lighter panels. When the panels are dried and finished they are simply tilted up to become vertical walls.

Another method employs pre-fabrication of the building panels that can be either constructed on or off-site and then moved into a specific position to form the walls, floors and roofs of a building structure These pre-fabricated panels are reinforced and joined to each other by metal studs and joists embedded in the panels.

It is generally recognized that the overall strength of a prefabricated building panel is, in large part, dependent upon the integrity of the bond that is created between the metal stud and the concrete panel after the concrete has hardened. For example, a stud edge surface in simple contact with the surface of the concrete panels results in a relatively weak bond and, therefore, a relatively weak panel. Accordingly, it has become a common technique to provide projections on the edge of the metal stud that extend into the wet concrete therefore securely anchoring the metal stud to the concrete panel when the concrete hardens.

By way of example, projections can be provided directly on the flange of a metal stud to anchor the stud to the panel. In one know method, the metal stud is shaped like a common "C" channel and has a planar central web and a pair of substantially perpendicular edge flanges. However, one edge flange has a series of spaced, longitudinally shaped cut-outs along its length, thereby permitting the cut-out portion of the edge flange to bend upwards and form a projection which can be embedded within the concrete material of the panel. A reinforcing mesh or the like can be mechanically attached to the projections so that the mesh is positioned at the proper depth within the panel. The drawback with these cutouts in the studs is that common "C" channel must be either specially modified or specially manufactured which adds to the cost of labor and material of the finished panel. One solution is the SteelCrete Punch Press available from Simple Building Systems, Inc., 27280 Jefferson Avenue, Suite 202, Temecula, Calif. 92590. The SteelCrete Punch Press has a series of hydraulic punches that when a length of C channel is inserted into the press, the cutouts or tabs are punched and formed. The problem with this system is that the SteelCrete Punch Press is so large that it is prohibitive to take to the job site, because of the heavy Punch Press the studs have to be shipped twice. From the stud manufacture to the Punch Press, unloaded, punched, reloaded and shipped to the client. This extra shipping and handling significantly raises costs.

Additionally, the higher cost of this press makes it not feasible for the smaller scale contractor.

Simple Building Systems, Inc. does supply pre-punched studs however, since the studs are specially modified or manufactured at an off-site manufacturing facility, the studs are not readily susceptible to further modifications or adjustments to meet unusual or special needs which may arise in the field.

Pre-punched studs also suffer from the additional storage space requirements and difficulties in stacking and shipping. With the pre-punched studs, the cut outs created prevent orderly stacking, increase the required volume for materials storage, are easily damaged or bent and make the normally linear metal stud difficult to handle.

Prior methods of forming metal studs for use with tilt up construction include sequentially cutting and then shaping tabs on metal studs. Such methods are generally not portable and not usable at a job site, as the linear travel required to have both cutting stations and shaping stations in sequence mechanically requires a travel greater than the width of a conventional vehicle and trailer. As the metal studs being punched may be of any length, it is desirable to be able to punch the studs in a manner so as not to interfere with a vehicle towing a punching unit, making prior art portable units impractical.

Another potential solution is described in a patent issued to Ruiz et al., U.S. Pat. No. 5,414,972 where a reinforced structural member is a two-piece assembly comprising a structural member and a reinforcing member. The reinforcing member is fastened to the structural member such that a series of projections extend from the reinforcing member are engaged in the building panel. Although this is a partial solution to the shipping problem, since less material is shipped, it requires significant additional labor to fasten the reinforcing member to the structural member raising costs.

Accordingly, there exists a need for a system and method of manufacturing a structural member that is a modification of a standard C channel metal stud used in the manufacture of thin shell tilt-up style construction panels that is easily and economically punched to form the tabs needed for embedment and attachment to the concrete.

Further there is a need for a system of economically punching tabs in a C channel metal stud that is compact, simple to operate and portable such that it may be readily used on a job site.

SUMMARY OF THE INVENTION

The present invention provides a system and method of modifying a standard C channel stud used in the manufacture of tilt-up style construction. By punching and forming a tab or series of tabs on one of the two parallel sides of the C channel, the tab becomes a concrete embedment with known engineering values of withdrawal and shear force. The tab also provides a ready point for reinforcing mesh to be easily attached and held in place with the tabs prior to pouring the cement or other wall construction material.

In the preferred embodiment, the entire device is such that a single punch and die are manipulated by a pair of hydraulic units such that the device may be readily mounted on a portable station, such as a trailer and towed and used as needed at a job site.

The metal stud punching system of the preferred embodiment of the present invention has an alignment frame with an adjustable infeed alignment port in a first side and an adjustable outfeed alignment port in an opposite side. There is a punch and die positioned within the alignment frame. A length of metal stud is inserted through the infeed alignment port, the ports are wide enough for different stud widths with one vertical side of the metal stud disposed between the punch and the die. A first hydraulic unit is attached to the punch and moves a first direction thereby inserting the punch into the die and punching a tab out of the vertical side of the metal stud. A second hydraulic unit moves the punch assembly in a direction perpendicular to the first direction of the first hydraulic unit. After the tab has been punched, the second hydraulic unit advances the metal stud by sliding the punch assembly a distance equal to the desired space between tabs. With the perpendicular movement, the punch inserted in the metal stud is dragging in the stud and pushing it out the outfeed alignment port. In the preferred embodiment, the die has one open side allowing the tab to slide through the die enabling the die to remain stationary rather needing to retract both the punch and the metal stud to avoid the tab. The punch is retracted by the first hydraulic unit and the punch assembly is returned to its original position by the second hydraulic unit.

BRIEF DESCRIPTION OF THE DRAWINGS

The above description and other objects, advantages, and features of the present invention will be more fully understood and appreciated by reference to the specification and accompanying drawings, wherein.

DETAILED DISCUSSION OF THE PREFERRED EMBODIMENTS

Referring to the figures, like elements retain their indicators throughout the several views.

Figure 1:
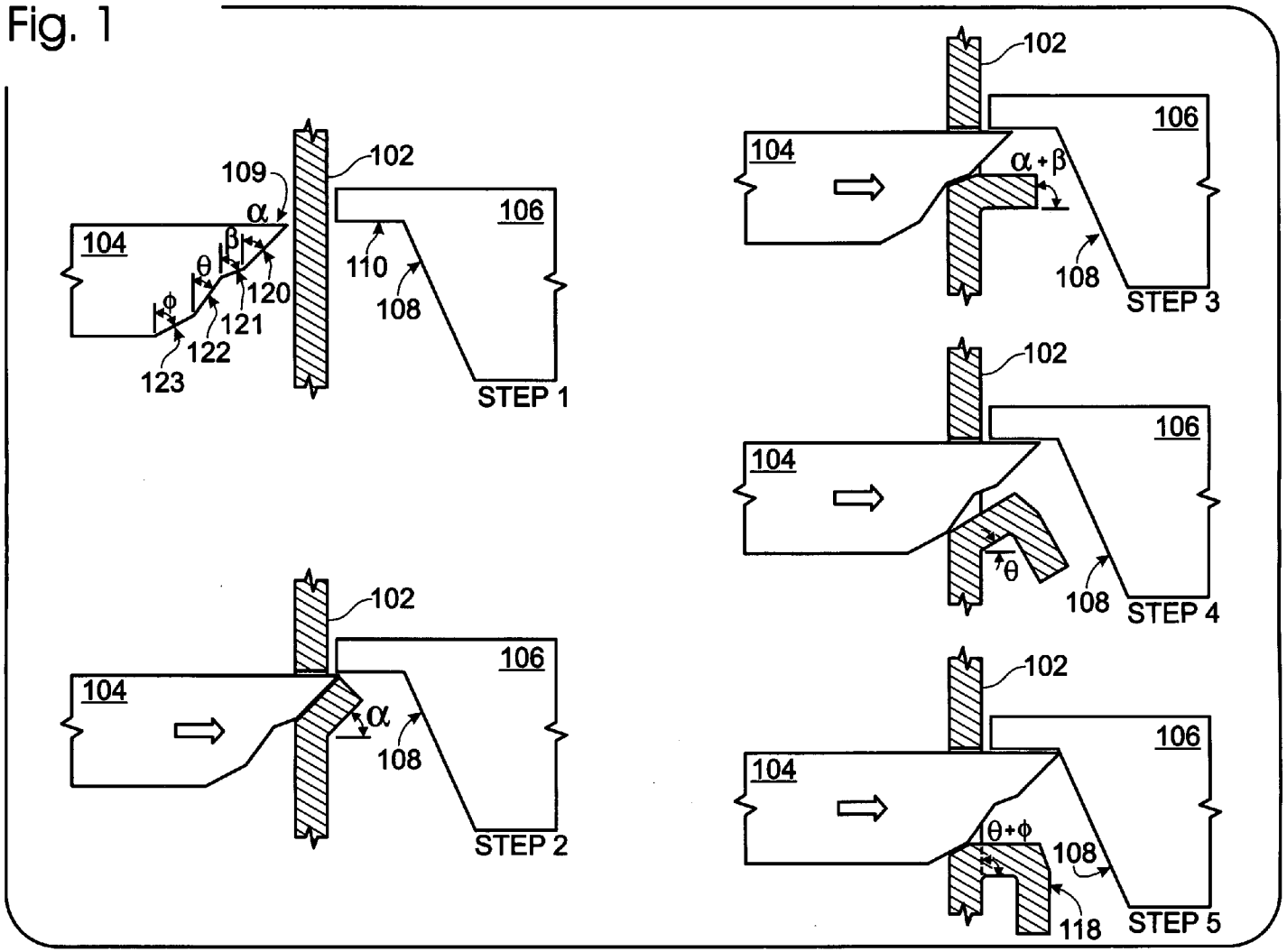
FIG. 1 is a cross-sectional view of the punch, die, and steel stock demonstrating the step-by-step punching and forming of the tab on the steel stock according to the preferred embodiment of the present invention.

FIG. 1 is a cross-sectional view of Punch 104, Die 106, and Steel Stock 102 demonstrating the step-by-step punching and forming of Tab 118 on Steel Stock 102 according to the preferred embodiment of the present invention.

In the preferred embodiment of the present invention, Punch 104 is a four-staged punch. In Step 1, as is typical with most punch and die systems, Punch 104 has a Shear Edge 109 that is closely aligned with Die Shear Edge 110 thereby minimizing the deflection of Steel Stock 102 and making a clean cut into Steel Stock 102. In Step 2, as Punch 104 punches into Steel Stock 102, First Surface 120 of Punch 104 deforms Steel Stock 102 by an angle Alpha ($\alpha$). In Step 3, Punch 104 continues toward Die 106 and Second Surface 121 deforms Steel Stock 102 by an angle Beta ($\beta$). In order to create an approximate 90 degree angle, Alpha and Beta sum to approximately 90 degrees. In the preferred embodiment, Alpha is smaller angle than Beta. However, it has been contemplated to make Alpha and Beta the same or close to the same size.

In Step 4, Punch 104 continues to move toward Die 106 and Third Surface 122 deforms Steel Stock 102 by an angle Theta ($\theta$). And, finally, in Step 5, Fourth Surface 123 deforms Steel Stock 102 by an angle Phi ($\phi$) thereby completing formation of Tab 118. As previously discussed with Alpha and Beta, angles Theta and Phi will sum to approximately 90 degrees with Theta being smaller than Phi in the preferred embodiment.

By creating the two angles in the tab it becomes, a concrete embedment with known engineering values of withdrawal and shear force that is part of the Steel Stock 102. This enables the framed stud that has been punched to attach to the concrete that is placed into the panel form thereby creating a concrete thin-shell tilt-up style wall, or a prefabricated ceiling or floor.

Figure 2:
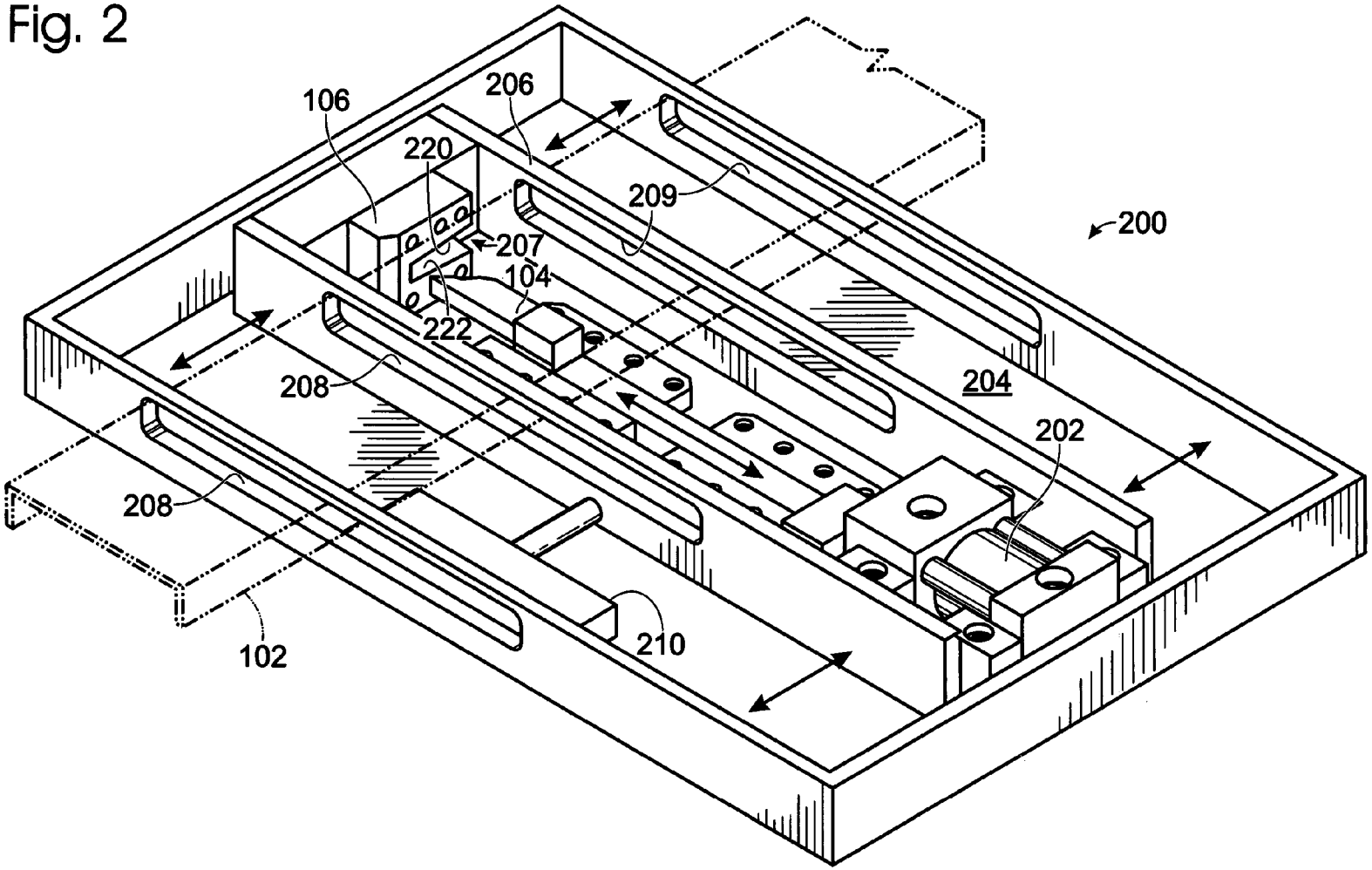
FIG. 2 is a plan view of the punch system according to the preferred embodiment of the present invention.

FIG. 2 is a plan view of Punch System 200 according to the preferred embodiment of the present invention. Punch System 200 is affixed to Support Deck 204. Alignment Frame 206 is both an inner and outer frame for Punch System 200 as well as an alignment device for feeding C channel stock into Punch System 200. A section of C channel is fed into Infeed Alignment Port 208 with one of the two parallel sides of the C-channel Steel Stock 102 between Punch 104 and Die 106. The C channel is slid out Outfeed Alignment Port 209. Hydraulic Unit 202 slides Punch 104 into Die 106 thereby punching and forming a tab on the C channel stud.

In the preferred embodiment, Die 106 is constructed with Die Open End 207 so that with Punch 104 still inside of Die 106, Second Hydraulic Unit 210 pushes, and thereby feeds, C-channel Steel Stock 102 a predetermined distance through Outfeed Alignment Port 209. Hydraulic Unit 202 is then retracted, thereby removing Punch 104 from Die 106. Second Hydraulic Unit 210 this returns the punch assembly to the original position to punch and is ready to punch the next tab. The Upper Sidewall and Lower Sidewall 222 of Die 106 are preferable slightly flared toward the Die Open End 207 to avoid the jamming or lodging of the tab created in the Die 106.

The ability to punch a single tab allows the unit to be small in size making it both portable to the job site as well as able to punch a single tab for a specialized application. The auto feed mechanism created by Second Hydraulic Unit 210 advancing and retracting Punch 104 can be adjusted to accommodate varying spacing between tab requirements. The width of the infeed 208 and outfeed 209 ports can accommodate adjusting guides for punching different stud width sizes.

Figure 3:
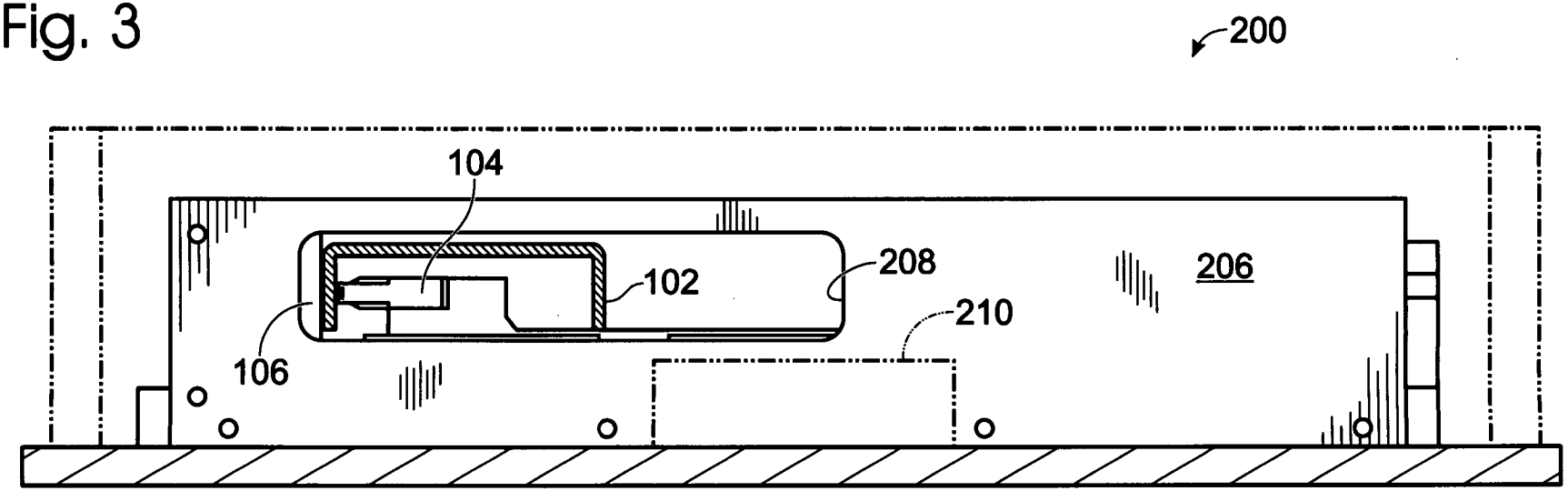
FIG. 3 is a side view of the punch system according to the preferred embodiment of the present invention.

FIG. 3 is a side view of the Punch System 200 according to the preferred embodiment of the present invention. Alignment Frame 206 is shown with Infeed Alignment Port 208 exposing Punch 104 from the side. The width of the infeed 208 and outfeed 209 ports can accommodate adjusting guides for punching different stud width sizes. C-channel Steel Stock 102 is shown in phantom positioned with one its two parallel sides in punching position between Punch 104 and Die 106 (not shown).

Figure 4:
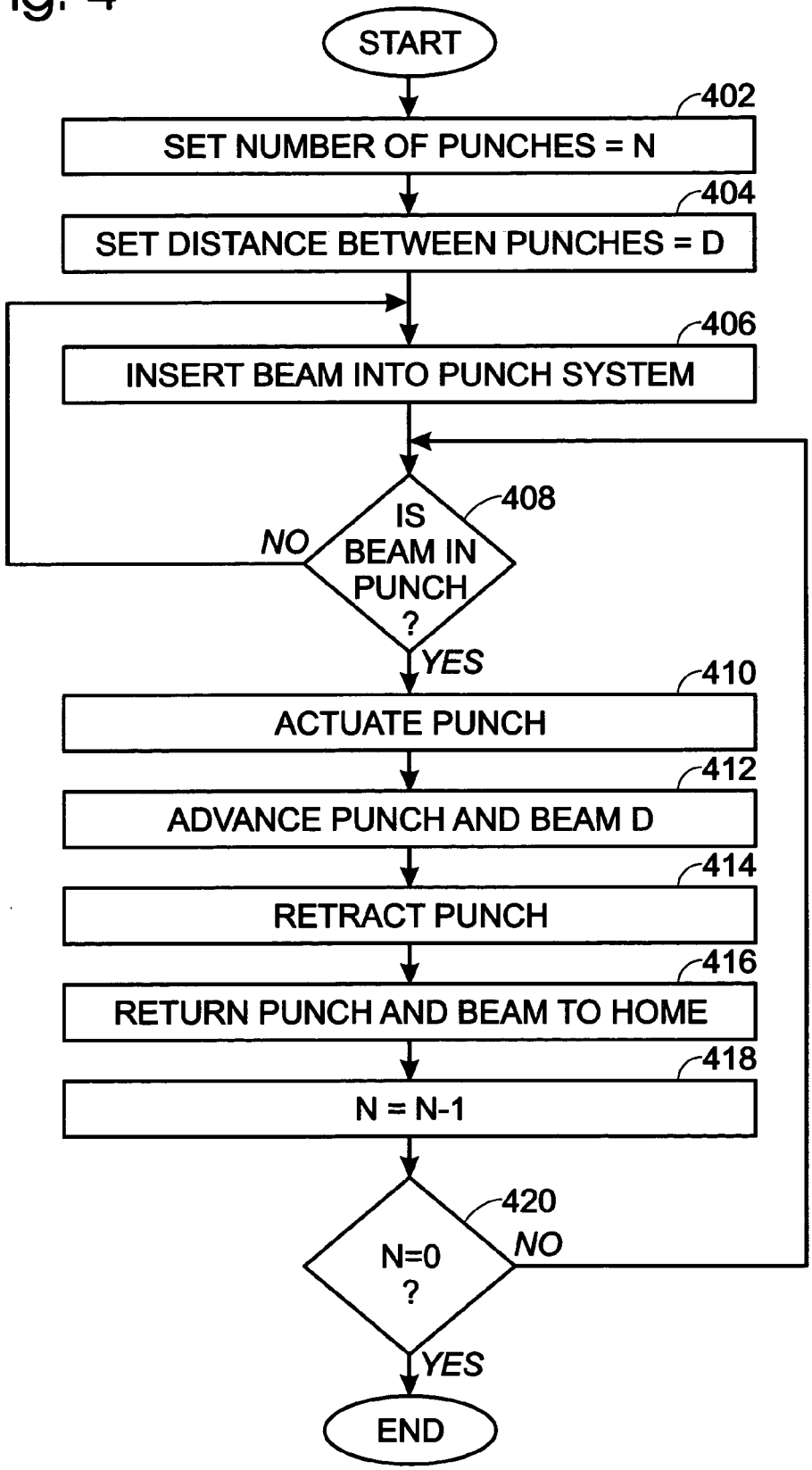
FIG. 4 is a flow diagram depicting the sequence of operation of the punch system according to the preferred embodiment of the present invention.

FIG. 4 is a flow diagram depicting the sequence of operation of Punch System 200 according to the preferred embodiment of the present invention. Block 402 accepts an input, N, that sets to number of tabs to be punched. Block 404 then accepts an input, D, that sets the distance the C-channel Steel Stock 102 will be advanced between punches leaving a space the length of D between each tab.

In Block 406, a section of C-channel Steel Stock 102 is inserted through Infeed Alignment Port 203 with one of the two parallel sides of Steel Stock 102 positioned between Punch 104 and Die 106. Control moves to Block 408 where the system checks for Steel Stock 102 to be in place. If there is no Steel Stock 102 in position to be punched, control moves back to Block 406 for Steel Stock 102 insertion. If there is Steel Stock 102 in place, control moves to Block 410 and a tab is punched in Steel Stock 102 by the actuation of Hydraulic Unit 202.

With Punch 104 still in Steel Stock 102, control moves to Block 412 where Second Hydraulic Unit 210 assisted by Punch 104 advances Steel Stock 102 a distance, D. In Block 414, Hydraulic Unit 202 is retracted and Punch 104 is returned to its open position and Block 416 returns Punch 104 to its position prior to advancing distance, D. In Block 418, tab counter N is decremented by one. Block 420 queries the value of N. If N is equal to zero, punching ceases. If N is greater than zero, control returns to Block 408 and punching continues until N equals zero. Blocks 408, 410, 412, 414 and 416 in sequence are cycled until the end of the Steel Stock 102, Block 408 senses there is no Steel Stock 102 in place and returns to Block 406 stopping and waiting for another piece Steel Stock 102 to be inserted into the machine. It is anticipated and disclosed that for convenience and ease of use in a best mode, N will be set to an infinite number for most operations and adjusted as need to a set number for specific needs. As such, the machine in standard mode will maintain operation so long as Steel Stock 102 is provided.

Figure 5:
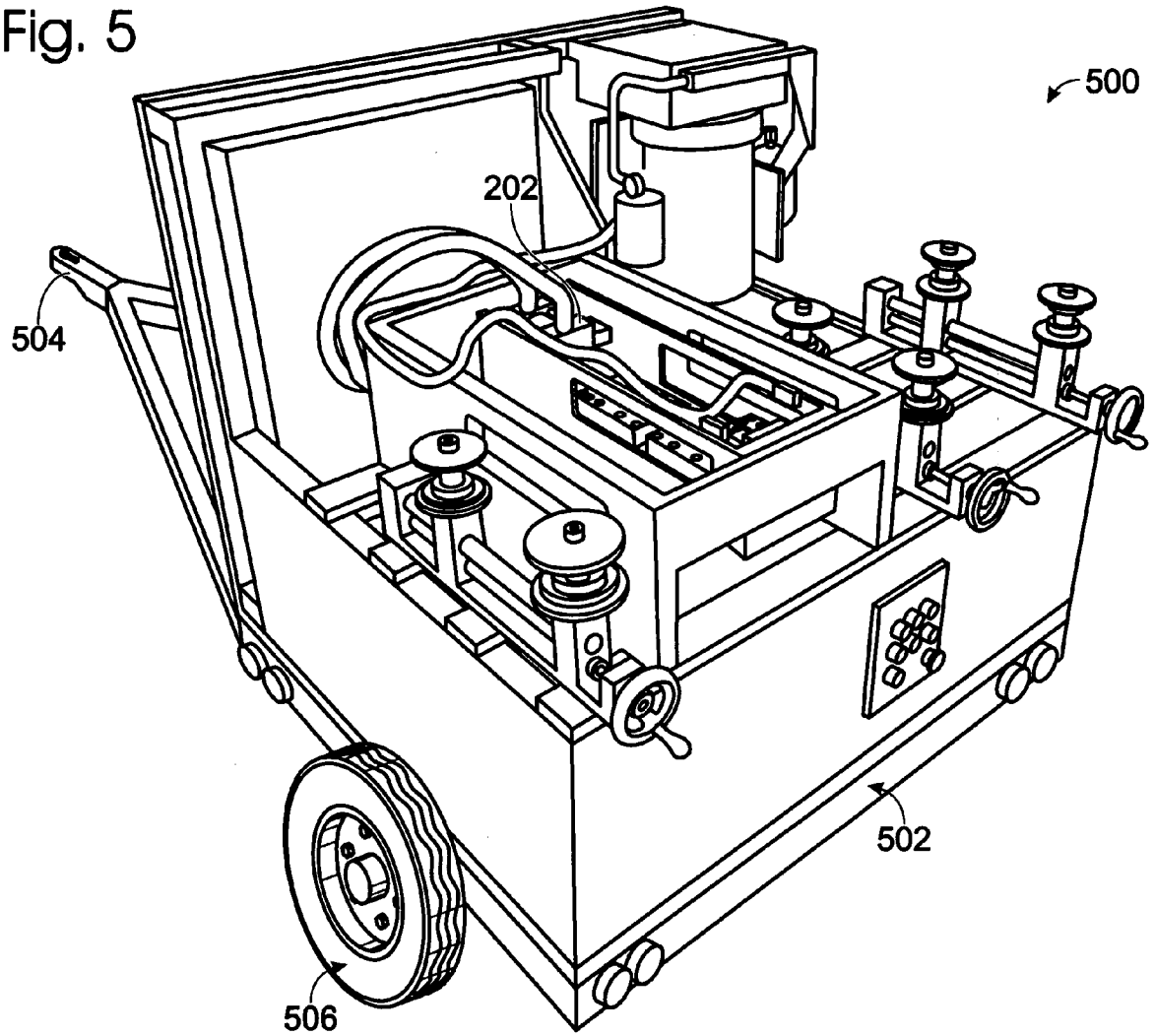
FIG. 5 is a depiction of the preferred embodiment mounted as a trailerable unit for transportation and use at a job site.

FIG. 5 is a representation of the Punch System 200 mounted as Trailered Punch Unit 500. Trailer Hitch 504 is quickly mounted to the trailer ball of a truck, car or van enabling the punching system to be portable to the job site. With this portable system, double shipping costs are eliminated and last minute design changes are easily accommodated at the job site minimizing the delay in ordering pre-punched studs or punching the metal studs back at the shop.

Figure 6:
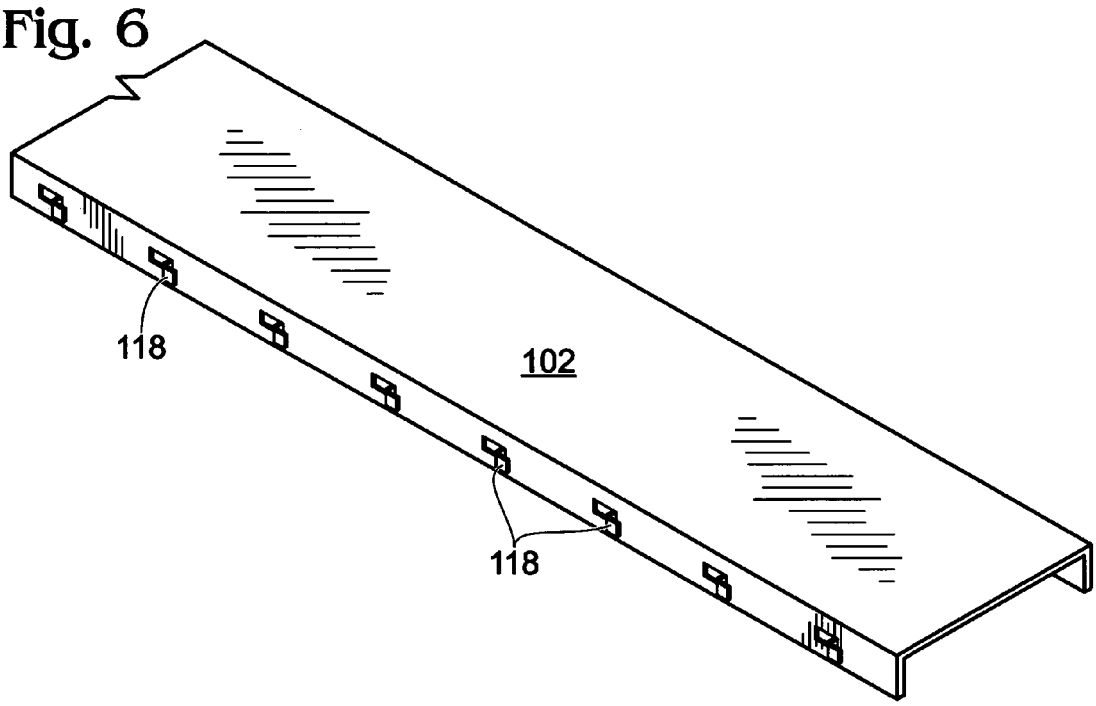
FIG. 6 is a plan view of a punched metal stud.

FIG. 6 shows Steel Stock 102 in its punched state. A series of Tabs 118 are shown punched down one side of Steel Stock 102.

Wherein the terms and expressions which have been employed in the foregoing specification are used therein as terms of description and not of limitation, there is no intention, in the use of such terms and expressions, of excluding equivalents of the features shown and described or portions thereof, it being recognized that the scope of the invention is defined and limited only by the claims which follow.

We claim:

1. A metal stud punch system, comprising:

an alignment frame having an infeed alignment port in a first side and an outfeed alignment port in a second side opposite said first side;

a punch positioned within said alignment frame;

a length of metal stud of a thickness having at least one vertical section attached on an edge perpendicularly to a second edge of a horizontal section;

a die with an upper side wall and an lower side wall, positioned within said alignment frame approximately said thickness away from said punch;

a first hydraulic unit fixedly attached to said punch, moves a first direction thereby inserting said punch into said die, and moves a second direction opposite said first direction thereby extracting said punch from said die; and a second hydraulic unit fixedly attached to said first hydraulic unit and said punch, moves a feed direction perpendicular to said first direction of said first hydraulic unit, and moves a return direction opposite said feed direction;

wherein, said metal stud is slidably inserted into said infeed alignment port of said alignment frame whereby said vertical section is disposed between said punch and said die, said punch is actuated by said first hydraulic unit into said die punching and forming an extending tab on said metal stud, said second hydraulic unit feeds said metal stud in said feed direction out said outfeed alignment port, said punch is retracted by said first hydraulic unit in said second direction, and said second hydraulic unit returns said punch and said first hydraulic unit by moving in said return direction.

2. The metal stud punch system of claim 1, wherein said metal stud is a C-channel stud having two parallel vertical sides attached to either side of a base plate creating a C-shaped cross-section.

3. The metal stud punch system of claim 1, wherein said die has at least one open side and three other sides sized slightly larger than said punch thereby able to receive said punch.

4. The metal stud punch of claim 1, where in said upper sidewall and said lower sidewall of said die are flared.

5. The metal stud punch system of claim 1, wherein said punch is a four cutting staged punch comprising;

a first stage cutting a tab from said metal stud at a first angle;

a second stage further cutting said tab a second angle wherein a first portion created by said first stage and said second stage cutting of said tab is projecting approximately perpendicular to said metal stud;

a third stage further cutting said tab to said first angle; and a fourth stage further cutting said tab to said second angle creating a second portion of said tab with said third stage and said fourth stage whereby said first portion of said tab is now parallel to said metal stud and said second portion is perpendicular to said metal stud.

6. The metal stud punch system of claim 1, mounted on a trailer.

7. A method of punching a tabbed metal stud, comprising the steps of:

inserting a first side of a metal stud between a punch and a die;

actuating said punch with a first hydraulic unit in a first direction whereby said punch cuts through said metal stud and slides into said die forming a tab on said metal stud;

advancing said metal stud and said punch a distance from an initial position to an advanced position in a direction perpendicular to said first direction with a second hydraulic unit;

retracting said punch with said first hydraulic unit in a second direction opposite said first direction;

returning said punch to said initial position with said second hydraulic unit whereby only said metal stud remains advanced, and punching continues until an end of said metal stud is reached thereby said tabs are punched said distance apart the length of said metal stud.

* * * * *